US008476514B2

(12) United States Patent
Dietz

(10) Patent No.: US 8,476,514 B2
(45) Date of Patent: Jul. 2, 2013

(54) PERCUSSION DEVICE

(76) Inventor: Ryan M. Dietz, Watertown, MA (US)

( * ) Notice: Subject to any disclaimer, the term of this patent is extended or adjusted under 35 U.S.C. 154(b) by 44 days.

(21) Appl. No.: 13/083,126

(22) Filed: Apr. 8, 2011

(65) Prior Publication Data

US 2011/0247476 A1 Oct. 13, 2011

Related U.S. Application Data

(60) Provisional application No. 61/321,968, filed on Apr. 8, 2010.

(51) Int. Cl.
*G10D 13/08* (2006.01)

(52) U.S. Cl.
USPC ..... 84/402

(58) Field of Classification Search
USPC ..... 84/422.4, 402–410
See application file for complete search history.

(56) References Cited

U.S. PATENT DOCUMENTS 4,970,934 A * 11/1990 Reed et al. ..... 84/422.4

* cited by examiner

*Primary Examiner* — Kimberly Lockett
(74) *Attorney, Agent, or Firm* — Nixon Peabody LLP; David S. Resnick; David F. Crosby

(57) ABSTRACT

The present invention is a percussion device to be utilized with a percussion tool, such as a drum stick. The percussion device comprises a support structure and a percussion accessory. The device provides for creating musical sounds in addition to the sounds created by the percussion tool.

16 Claims, 7 Drawing Sheets

PERCUSSION DEVICE

REFERENCE TO RELATED APPLICATIONS

This application claims all benefits provided by law including the benefits under 35 U.S.C. §119(e) of U.S. Patent Application No. 61/321,968 filed on Apr. 8, 2010, which hereby incorporated by reference in its entirety.

BACKGROUND

1. Field of the Invention

The present invention relates generally to percussion instruments. More particularly, the present invention relates to a percussion instrument device which can be used in combination with a percussion tool, such as a drum stick, and comprises one or more percussion accessories.

2. Background

Currently, there are numerous percussion instruments, such as tambourines, cow bells, and maracas which are used to add rhythm and artistry to a musical work. Typically, these instruments are held alone in a user's hand and are shaken, struck with the user's other hand, a drum stick or other percussion tool, or a combination of one or more of the above. Therefore, when a user utilizes his or her hand or hands to play the percussion instrument, those hands are no longer available to play other percussion instruments, or to play other instruments in general.

Therefore, aspects of the present invention are directed to solving these and other problems by providing a device to be held in the hand along with a percussion tool, such as a drum stick, providing addition rhythm percussion sounds while a user plays another instrument.

SUMMARY

The following presents a simplified summary of the invention in order to provide an understanding of some aspects of the invention. This summary is not an extensive overview of the invention. Its sole purpose is to present some concepts of the invention in a simplified form as a prelude to the more detailed description that is presented later.

In an aspect of the invention, the present invention relates to a percussion device to be used in combination with a percussion tool, such as a drum stick or mallet. The device can include a support structure and a percussion accessory. In one embodiment of the invention, the support structure can include a base portion, a handle portion, and a tower portion, or a base portion, and a handle portion. In either instance, the base portion can include a cavity for engaging or housing the base or end of a percussion tool, wherein the handle portion comprises a shaft extending along an axis extending from the base portion, and wherein the tower portion or handle portion comprises an attaching or fastening component to enable the device to be attached one or more percussion accessories. The percussion accessory can also include an attaching or fastening component to attach the percussion accessory to the handle portion or the tower portion.

Other aspects, advantages, and certain illustrative aspects and novel features of the invention are described herein in connection with the following detailed description and the accompanying drawings, and in part will become apparent to those skilled in the art upon examination of the following, or can be learned by practice of the invention. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawing.

In addition, while a particular feature of the invention may have been disclosed with respect to only one of several implementations, such feature may be combined with one or more other features of the other implementations as may be desired and advantageous for any given or particular application.

BRIEF DESCRIPTION OF THE DRAWING FIGURES

DETAILED DESCRIPTION

Figure 1:
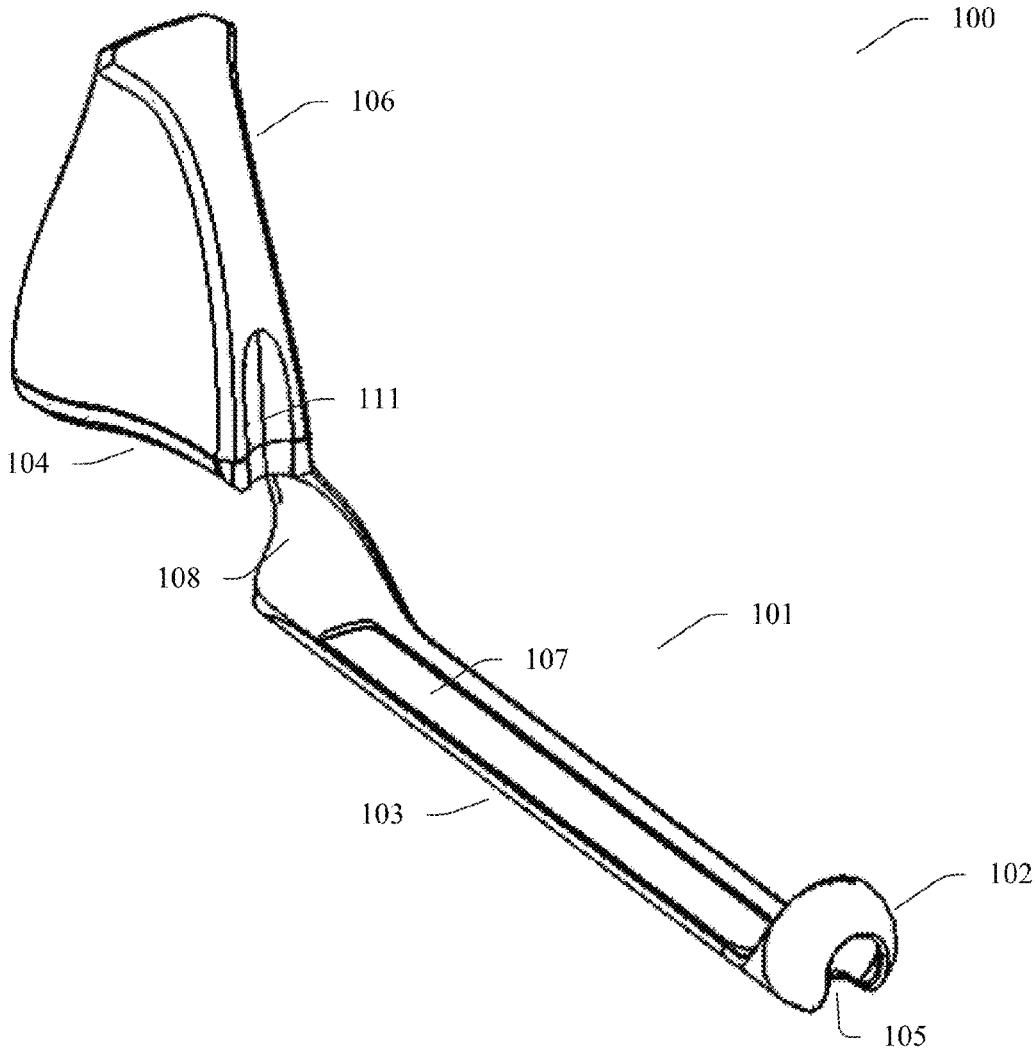
FIG. 1 illustrates a perspective view in accordance with an aspect of the invention.

The forgoing as well as other aspects and advantages of the invention will become apparent from the following detailed description when considered in conjunction with the accompanying drawings and other material, wherein like reference characters designate like parts throughout the several views. In the following description, for purposes of explanation, numerous specific details are set forth in order to provide a thorough understanding of the subject invention. It may be evident, however, that the invention can be practiced without these specific details. It should also be appreciated that although specific examples presented may describe or depict certain aspects of the subject invention, the invention is not limited to those aspects. Those of ordinary skill in the art will readily recognize that the disclosed invention can be used for other purposes and in other manners other than those described.

As used herein, the term "percussion tool" refers to, but is not limited to, a drumstick, as well as brushes, mallets, percussion instruments, multi-rod drumsticks and instruments or parts of instruments that include elongated handles.

FIG. 1 illustrates a perspective view in accordance with an aspect of the invention, where the device is represented generally at 100. Device 100 comprises support structure, represented generally at 101, and percussion accessory 106. In accordance with one embodiment of the invention, the Support structure 101 can include a base portion 102, a handle portion 103, and a tower portion 104, wherein the base portion 102 can include a cavity 105 to house the base or end of a percussion tool and the handle portion 103 can include a shaft extending along an axis extending from the base portion 102. Tower portion 104 can include an attaching component to enable one or more percussion accessories 106 to be attached to the tower portion 104. Device 100 can be removably attached or incorporated with a percussion tool before, during or after operation of a percussion instrument.

Base portion 102 can optionally include a cavity 105 to engage or house the base of a percussion tool, such as a drumstick or a mallet. Device 100, and aspects thereof, can be sized to fit one or more percussion tools. For example, device 100 can be customized to house drumsticks based on the size, circumference, diameter, length, and weight of the drum stick. Therefore, aspects of the invention, including cavity 105, can be adapted according to its intended use.

Handle portion 103 can include a shaft extending along an axis that extends from base portion 102. Handle portion 103 can partially or totally enclose a portion of a percussion tool when inserted into device 100. Handle portion 103 can be elongated and extend between base portion 102 and tower portion 104. Handle portion 103 can be positioned on the top or bottom of the percussion tool when inserted into device 100. In an aspect, handle portion 103 can partially enclose a percussion tool and can comprise one or more openings 107, where the hand and/or fingers of a user can remain in contact with the percussion tool providing increased control over both the percussion tool and percussion device 100. Handle portion 103, and the one or more openings 107, maximize contact between the user's hand and the percussion tool to ensure control is maintained and to minimize any adjustments in the user's playing style. Handle portion 103 can be manufactured to fit comfortably within a user's hand, knuckles, or bends in the fingers/hands (e.g. handle portion 103 can wrap around a percussion tool). In accordance with one embodiment of the invention, when in use, handle portion 103 will be located between a user's hand and a percussion tool. Handle portion 103 can enclose a percussion tool whereby when the percussion tool is inserted into handle portion 103 it is removably secured thereto via one or more locking mechanisms or pressure fit. Alternatively, the percussion tool can be loosely connected and used in combination with device 100 whereby the percussion tool and device 100 can be secured within the hand of the user.

In accordance with one embodiment of the invention, the tower portion 104 can be located at an end opposite that of base portion 102, extends perpendicularly to or radially from one or more sides of handle portion 103, and provides an attaching device or component for attaching one or more percussion accessories to the handle portion 103. Tower portion 104 can extend perpendicularly to or radially on an extension or arm 108 from on one or more sides of handle portion 103 whereby tower portion 104 can wrap around one or more sides of a percussion tool providing for secured attachment and rigidity of the percussion tool. When device 100 is in use, tower portion 104 can be situated on top of the percussion tool so that no interference is created during drum play. In an aspect, tower portion 104 can include a concave section 111 which allows for close proximity of the user's hand or thumb to the percussion accessory 106, while being held in combination with the percussion tool. Tower portion 104 can include on or more attaching, fastening, or anchoring mechanisms for attaching one or more percussion accessories 106 to the tower portion 104. The attaching mechanism can include, but is not limited to, at least one or more of a mechanical fastener such as a hinge, latch, detent, slot, strap, clamp, screw, rivet, pin, nut, bolt, or locknut or solvent bonding such as an epoxy, glue, or other adhesive. In addition, the attaching mechanism can include at least one or more forms of fusion bonding such as plasticizing, hot-gas welding, vibration welding, solvent bonding, ultrasonic welding, induction welding, or dielectric welding. Tower portion 104 and percussion accessory 106 can be removably attached or permanently attached to one another.

Tower portion 104 could further be attached directly to percussion tool by screw, clip, clamp, strap, bolt or other attaching mechanisms eliminating the need for handle portion 103 and base portion 102.

Percussion accessory 106 can include attaching, fastening, or anchoring mechanisms or mating mechanisms for attaching the percussion accessory 106 to tower portion 104. Percussion accessory 106 can comprise one or more shakers, maracas, tambourines, scrapers, castanets, cow bells, woodblocks, claves, jingle bells and the like. In the example of a shaker, percussion accessory 106 can comprise a hollow core (e.g. chamber) partially filled with loose objects, such as beads, which create percussion sounds as they are used. In the example of a tambourine, percussion accessory 106 can comprise one or more openings to house tambourine jingles, which create percussion sounds as they are used. Percussion accessory 106 can be designed to ensure minimal interference with playing surfaces (e.g. drum heads, rims, hi-hats, or cymbals) while device 100 is in use, as the percussion accessory 106 can be located on top, bottom, or side of the percussion tool away from other instruments. Percussion accessory 106 can be further designed to ensure minimal interference with playing surfaces by angling the percussion accessory 106 toward or away from the user. The angled mounting can position the percussion accessory 106 above or away from the user's hands so the device, in use, does not interfere with the actions of the user based upon the user's natural ability to locate their hands and avoid hitting their hands and thereby avoid hitting percussion accessory 106.

Percussion accessory 106 could further be attached directly to percussion tool by means of one or more screws, bolts, clips, clamps, straps (e.g., Velcro™) or other mechanisms of attachment eliminating the need for handle portion 103 and base portion 102.

Device 100, and the parts associated therewith, can be fabricated from at least one or more of a plastic, thermoplastic, polymer, thermoset, elastomer, epoxy, alloy, polystyrene, polyethylene, polypropylene, ABS (acrylonitrile-butadiene-styrene), nylon, wood, or metal. Furthermore, in an aspect, device 100 can be manufacture through at least one or more processes such as injection, compression, extrusion, or blow molding as well as press or vacuum forming as well as carving, molding, forming, or the like.

Figure 2:
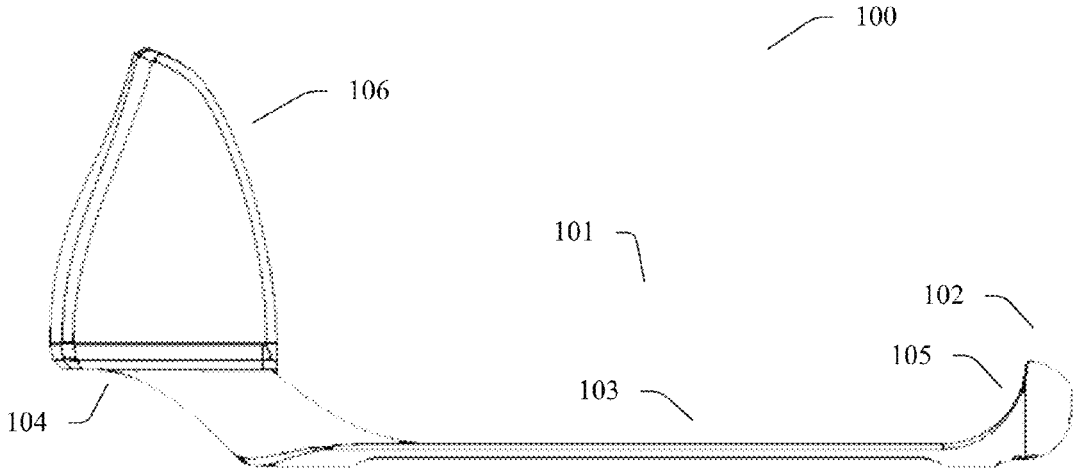
FIG. 2 illustrates a side view in accordance with an aspect of the invention.

FIG. 2 illustrates a side view of device 100 in accordance with an aspect of the invention. Base portion 102 comprises cavity 105 to house the base of a percussion tool (e.g. a drumstick). Percussion tool can be removably attached or loosely contained within cavity 105 and handle portion 103. Furthermore, tower portion 104 can extend perpendicularly to or radially from one or more sides of handle portion 103, or provide a circular enclosure, at an end opposite that of base portion 102, thereby securing percussion accessory 106 on top of the percussion tool.

Figure 3:
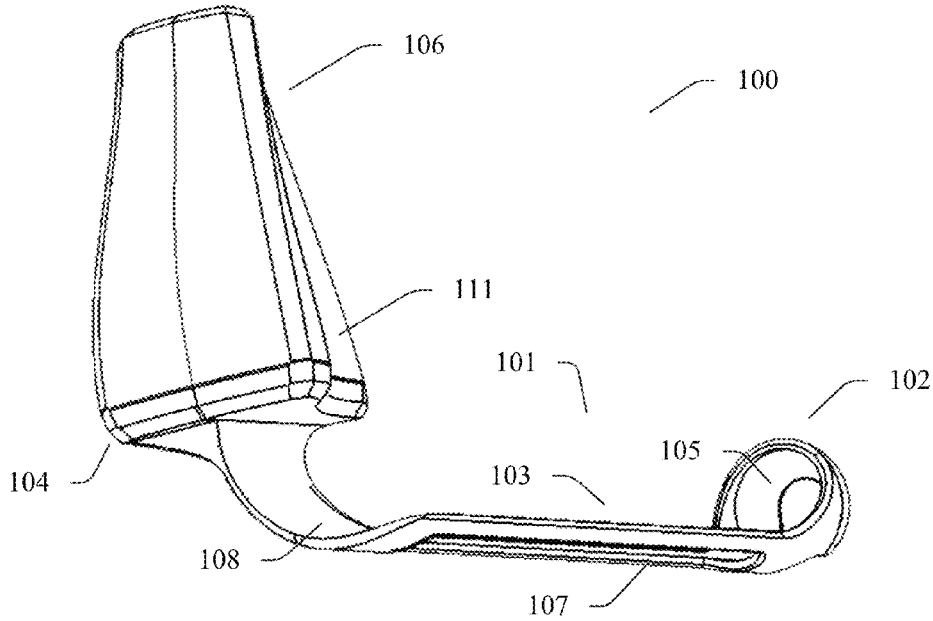
FIG. 3 illustrates a perspective view in accordance with another aspect of the invention.

FIG. 3 illustrates a perspective view in accordance with another aspect of the invention. Tower portion 104 can extend perpendicularly to or radially from one or more sides of handle portion 103 at an end opposite that of base portion 102. Extension 108 allows for securing a percussion tool within device 100 and maintains the percussion tools rigidity during use. In addition, extension 108 allows for tower portion 104 and percussion accessory 106 to be positioned in a manner which limits inference with percussion tool's interaction with the percussion instrument being played. Concave section 111 provides for close proximity between the user's hand and device 100.

Figure 4:
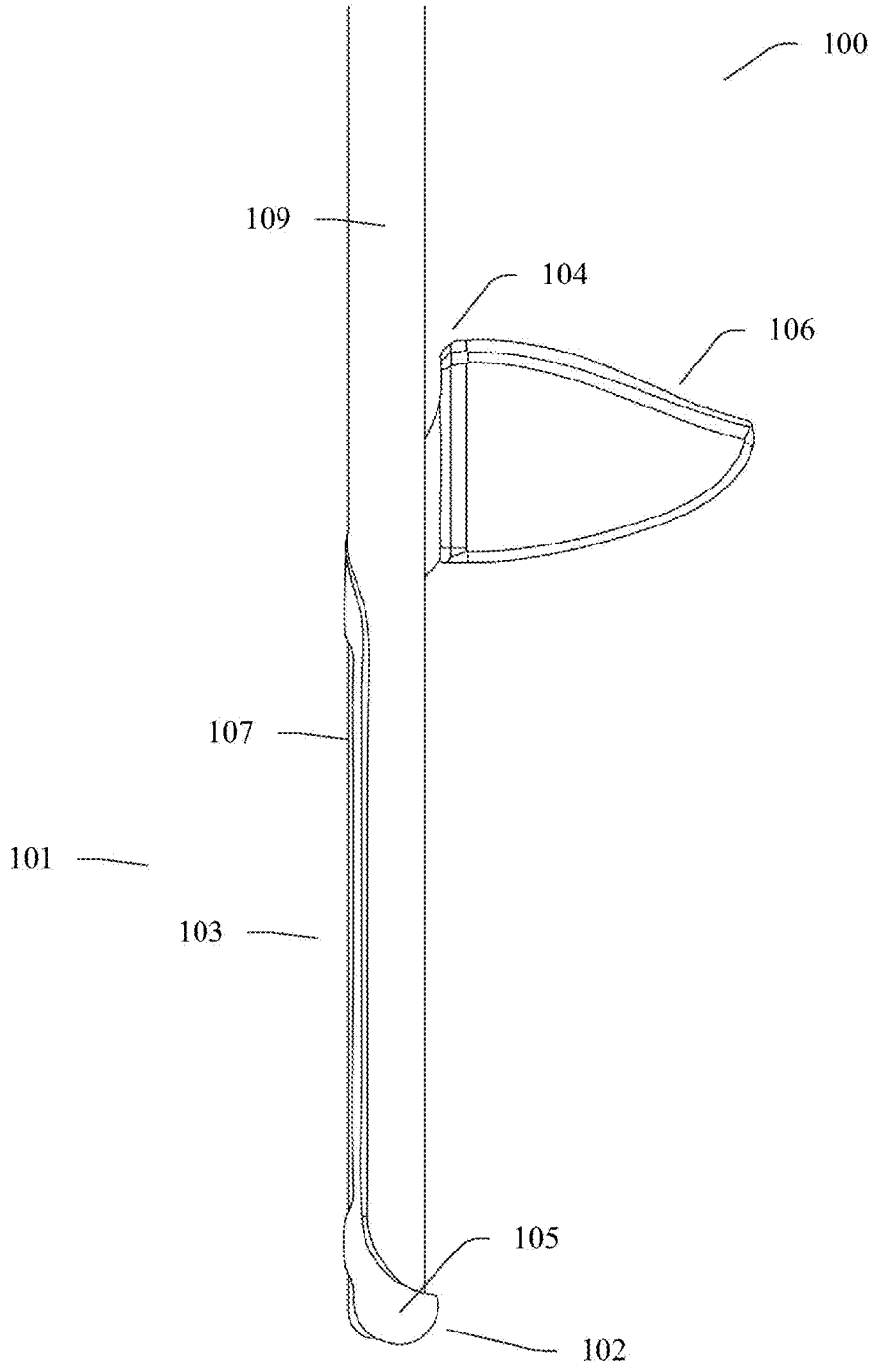
FIG. 4 illustrates a device in accordance with an aspect of the invention.

FIG. 4 illustrates a device in accordance with an aspect of the invention. Device 100 houses percussion tool (e.g. drum stick) 109. Percussion tool 109 is housed within base portion 102 (e.g. cavity 105), handle portion 103, and tower portion 104. Tower portion 104 extends perpendicularly on one or more sides of handle portion 103 whereby the extension provides a means for attaching a percussion accessory 106 on a side opposite that of handle portion 103. In an aspect, when in use, handle portion 103 will be located between a user's hand and the percussion tool 109, as illustrated in FIG. 5.

Figure 5:
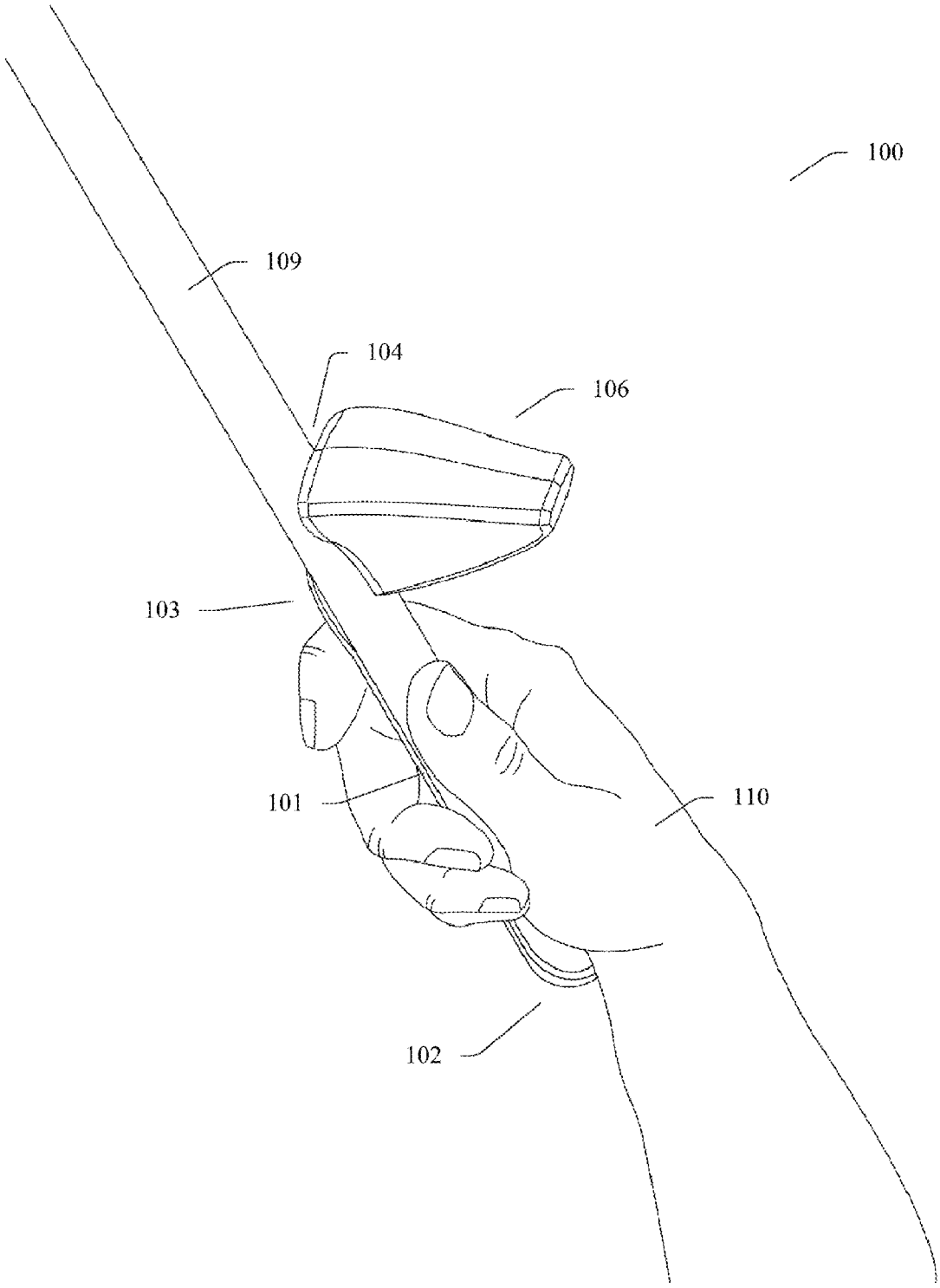
FIG. 5 illustrates a device in accordance with another aspect of the invention.

FIG. 5 illustrates a device in accordance with an aspect of the invention. Device 100 houses percussion tool 109 and is being held by a user 110. Support structure 101, comprises handle portion 103, base portion 102 and tower portion 104, and houses percussion tool 109. Device 100 and percussion tool 109 are being held within the user's hand 110 providing for control of both device 101 and percussion tool 109. Percussion accessory 106 is positioned on top of the percussion tool 109 allowing for minimal interference with other devices and normal playability. Device 100 can be removably attached or loosely connected within support structure 101.

In an aspect, when in use, percussion accessory 106 carries a portion of its mass towards or over a user's hand, thereby lowering its profile and ensuring no interference with normal playing styles such as mixed grip and overhand on hi-hat. This aspect takes advantage of a user's natural ability to know where their hands are during play and ensures that a user utilizing device 100 does not come into contact with other devices while in use.

Figure 6:
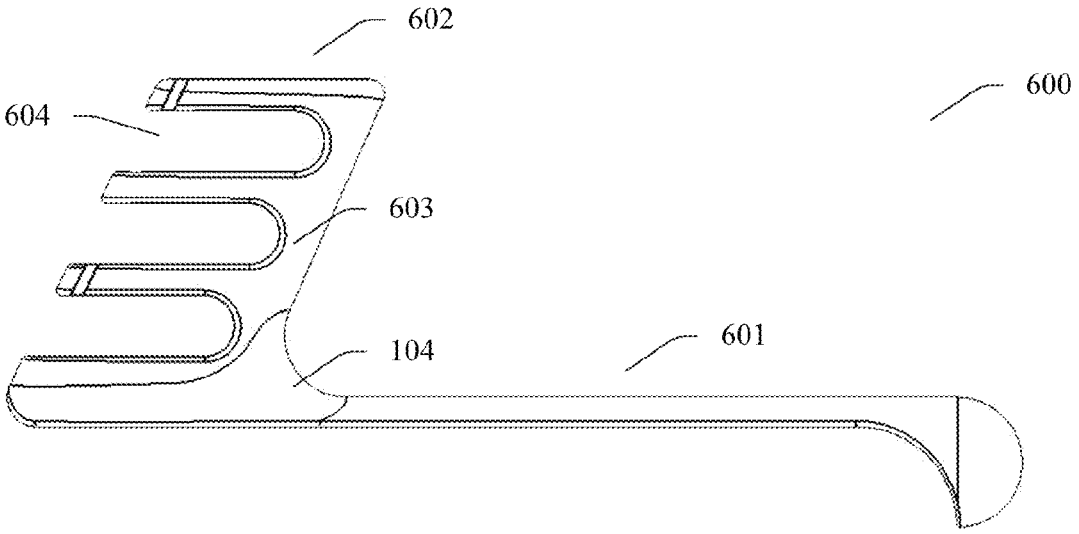
FIG. 6 illustrates a device in accordance with yet another aspect of the invention.
Figure 7:
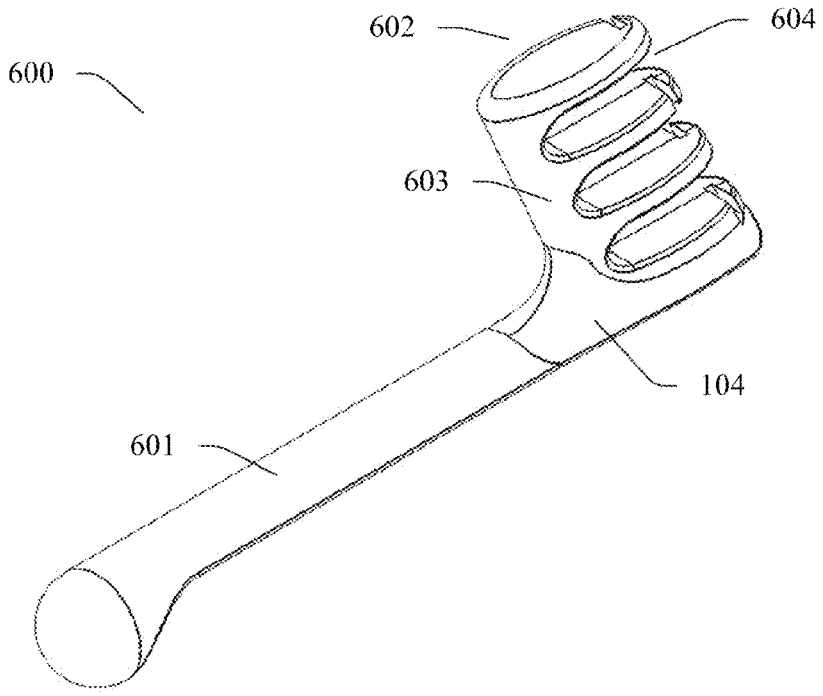
FIG. 7 illustrates a perspective view of a device in accordance with an additional aspect of the invention.

FIGS. 6 and 7 illustrate a device in accordance with another aspect of the invention, represented generally at 600. In an aspect, device 600 comprises handle portion 601, tower portion 104, and tambourine accessory 602. Handle portion 601, when in use with a percussion tool, is located on the top of said percussion tool. Tambourine accessory 602 is secured to tower portion 104. Tambourine accessory 602 comprises shell 603 and jingles (not shown). Shell 603 comprises one or more recessed sections 604 to install one or more jingles. Jingles can comprise brass or steel and can include dimpled sections to provide alternative tonality.

Figure 8:
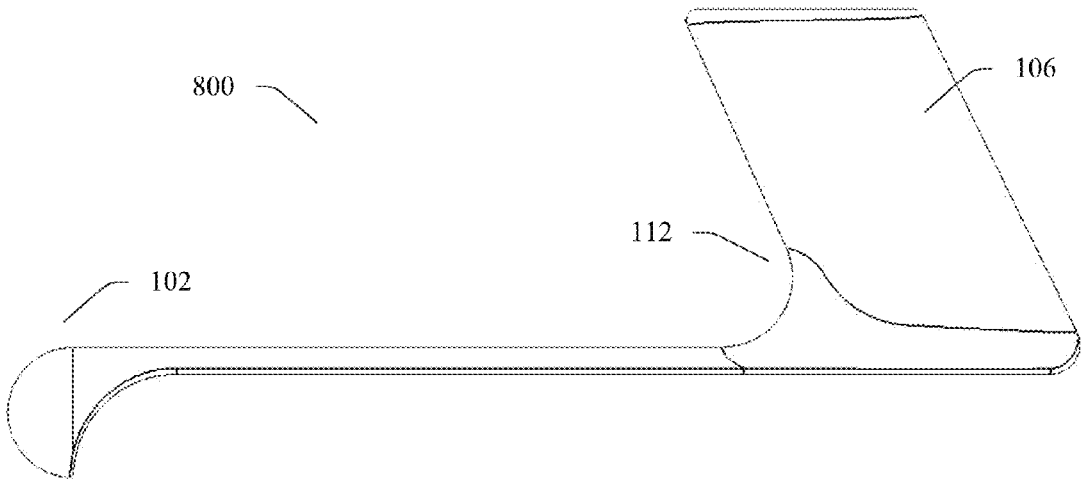
FIG. 8 illustrates a device in accordance with a further aspect of the invention.

FIG. 8 illustrates a device in accordance with a further aspect of the invention, represented generally at 800. Percussion accessory 106 is connected directly to the handle portion 103 and positioned and angled 112 towards base portion 102, whereby when in use percussion accessory 106 is located towards or over a user's hand. By lowering the profile of percussion accessory 106 the device 800 limits the interference device 800 has with normal playing styles such as mixed grip and overhand on hi-hat.

Figure 9:
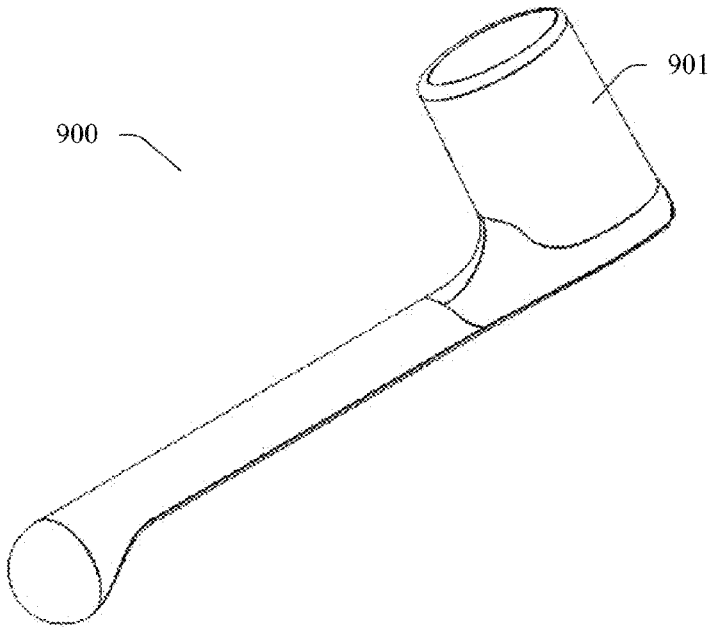
FIG. 9 illustrates a device in accordance with an additional aspect of the invention.

FIG. 9 illustrates a device in accordance with an additional aspect of the invention, represented generally at 900. Device 900 comprises a ¾ shaker accessory 901. Percussion accessory 901 is connected directly to the handle portion 103 and the percussion accessory 901 is angled toward the base portion 102.

Figure 10:
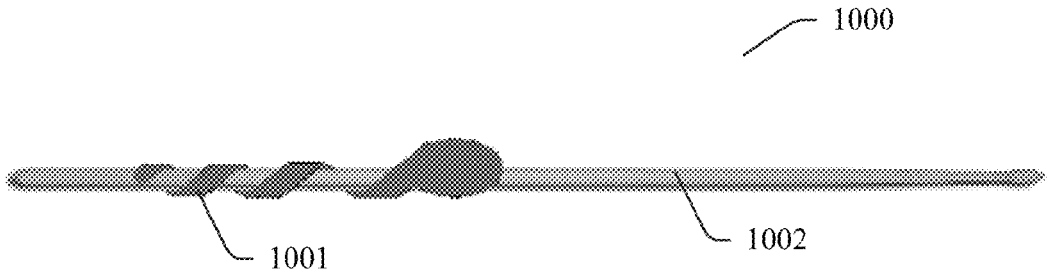
FIG. 10 illustrates a device in accordance with another aspect of the invention.

FIG. 10 illustrates a device in accordance with another aspect of the invention, represented generally at 1000. Device 1000 comprises handle portion 1001 which spirals around percussion tool 1002. Handle portion 1001 can removably attached device 1000 to percussion tool 1002.

Figure 11:
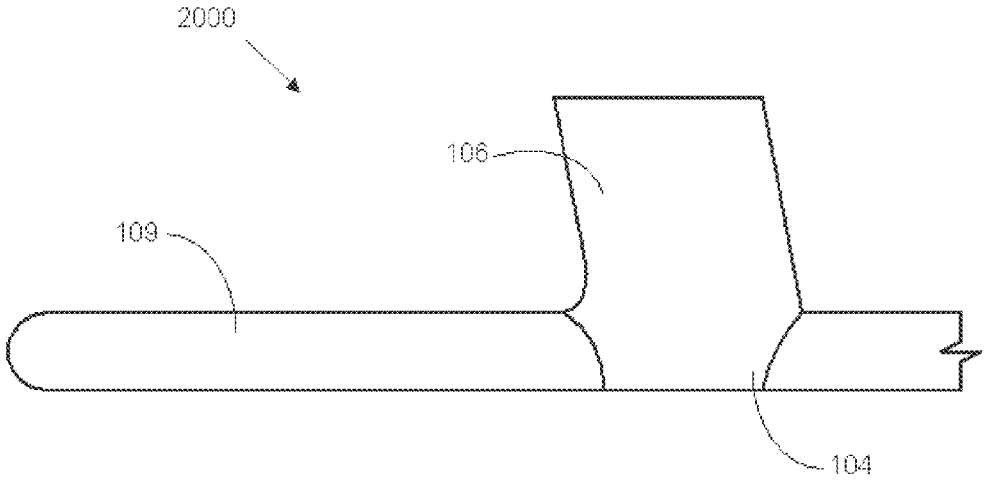
FIG. 11 illustrates a device in accordance with another aspect of the invention.

FIG. 11 illustrates a device in accordance with another aspect of the invention represented generally at 2000. Device 2000 comprises tower portion 104 attached directly to percussion tool 109. Percussion accessory 106 can be located above, below or to the side of percussion tool 109 and can be angled towards or away from the user's hand or position on the percussion tool 109 where the user places their hand. The percussion accessory 106 can include a tower portion 104 that is formed to engage and wrap around percussion tool 109. The tower portion 104 can slide over the percussion tool 109 and be held in place by a compression or interference fit. Alternatively, tower portion 104 can include one or more bolts or screws that hold tower portion 104 to form a clamp on the percussion tool 109 or one or more bolts or screws can extend into the percussion tool 109.

In an aspect, the percussion device incorporates a wired or wireless trigger for cueing music samples. For example, internal or external hardware comprising one or more of a speaker, conducting strands, trigger (e.g. push button or lever), power source, and memory device can be adapted for providing one or more music samples to the user. For example, a sample can be provided on a general or special purpose computer, keyboard, or the device via an internal computer, playing device.

In an additional aspect, the tower portion can include one or more lights to create a dramatic effect or which can present a visual display that can be coordinated with the rhythm of percussion instrument being played, the percussion tool or the percussion device. Furthermore, it is envisioned that the one or more lights can be utilized as a metronome that can visually cue the user as to a desired tempo such. For example, the one or more lights can flash at 100 beats per minute. The one or more lights can comprise any style LED and any color. The one or more lights can comprise one or more of a light source, conducting strands, power source, on/off switch, a special or general purpose computer, a memory device, and trigger. One or more triggers can be communicatively attached to the one or more lights or sound sources to provide a means for activating said source.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the invention are possible. Accordingly, the disclosed subject matter is intended to embrace all such alterations, modifications and variations that fall within the spirit and scope of the appended claims. Furthermore, to the extent that the term "includes," "has" or "having" or variations in the form thereof are used in either the detailed description or the claims, such terms are intended to be inclusive in a manner similar to the term "comprising" as "comprising" is interpreted when employed as a transitional word in a claim.

What is claimed is:

1. A percussion device for attaching a percussion accessory to a percussion tool, the percussion device comprising:

a support structure, wherein the support structure comprises a base portion, a handle portion, and a tower portion connected to the handle portion; and one or more percussion accessories attached to the tower portion.

2. The percussion device of claim 1, wherein the base portion comprises a cavity for housing a handle of a percussion tool.

3. The percussion device of claim 2, wherein the handle portion comprises a shaft extending along an axis extending from the base portion.

4. The percussion device of claim 3, wherein the handle portion partially encloses the percussion tool.

5. The percussion device of claim 4, wherein the handle portion further comprises one or more openings.

6. The percussion device of claim 1, wherein the tower portion extends perpendicularly to the handle portion at an end opposite that of the base portion.

7. The percussion device of claim 1, wherein the tower portion is attached to one or more percussion accessories by at least one attaching component.

8. The percussion device of claim 7 wherein the tower portion is attached to one or more percussion accessories by at least one or more of a detent, screw, rivet, pin, nut, bolt and locknut.

9. The percussion device of claim 6, wherein the tower portion and percussion accessory are combined through at least a fusion bond.

10. The percussion device of claim 1, wherein the one or more percussion accessories comprises at least one of a shaker, maraca, symbol, tambourine, scraper, castanet, cowbell, woodblock, bell, clave or other percussion instrument.

11. The percussion device of claim 10, further comprising one or more triggers.

12. The percussion device of claim 11, further comprising at least one or more of a light and sound source.

13. The percussion device of claim 12, wherein the one or more triggers are communicatively attached to at least the one or more light and sound source and provide a means for utilizing said light and sound source.

14. The percussion device of claim 1, wherein the tower portion is connected to the handle portion by an extension.

15. A percussion device for attaching a percussion accessory to a percussion tool, the percussion device comprising:

a support structure, wherein the support structure comprises a tower portion adapted to be attached to a percussion tool; and one or more percussion accessories fastened to the tower portion, wherein the percussion accessory extends at an angle with respect to the percussion tool, when the tower portion is attached to the percussion tool.

16. A percussion device for attaching a percussion accessory to a percussion tool, the percussion device comprising:

a support structure, wherein the support structure comprises a tower portion adapted to be attached to a percussion tool; and one or more percussion accessories fastened to the tower portion, wherein the percussion accessory extends above to the percussion tool, when the tower portion is attached to the percussion tool.

* * * * *